United States Patent [19]

Liu

[11] Patent Number: 4,848,562

[45] Date of Patent: Jul. 18, 1989

[54] PIN COLLECTOR BAG

[75] Inventor: Jack W. Liu, New York, N.Y.

[73] Assignee: Ho Ho Art & Craft International Co., Inc., New York, N.Y.

[21] Appl. No.: 278,364

[22] Filed: Dec. 1, 1988

[51] Int. Cl.[4] ..... B65D 23/12

[52] U.S. Cl. ..... 206/44.11; 150/108; 206/45.14; 206/566

[58] Field of Search ..... 206/44.11, 44 R, 44 B, 206/45.14, 45.15, 45.17, 566

[56] References Cited

U.S. PATENT DOCUMENTS

| | | | |
|---|---|---|---|
| 4,52,827 | 9/1985 | Pilzer | 206/44.11 |
| 2,076,683 | 4/1937 | Tharp | 206/44.11 |
| 2,797,806 | 7/1957 | Davis | 206/566 X |
| 3,900,060 | 8/1975 | Shammas | 206/45.14 |
| 4,153,092 | 5/1979 | Haslam | 150/108 |
| 4,350,249 | 9/1982 | Caston | 206/566 |
| 4,401,219 | 8/1983 | Mink | 206/566 |
| 4,465,179 | 8/1984 | Miller | 206/566 |
| 4,720,012 | 1/1988 | Du Four | 206/472 |
| 4,735,246 | 4/1988 | Niehaus | 206/45.14 |
| 4,796,735 | 1/1989 | Horiuchi | 150/108 |

*Primary Examiner*—William Price

*Attorney, Agent, or Firm*—Lalos & Keegan

[57] ABSTRACT

A soft, flexible bag for carrying and displaying collectible items such as pins. The bag contains soft fabric panels for displaying the pins with interleaved soft pouches for storing pins not on display.

27 Claims, 2 Drawing Sheets

PIN COLLECTOR BAG

BACKGROUND OF THE INVENTION

The present invention is related to carrying cases for samples or merchandise and is more specifically related to portable cases for storing collectible items such as pins.

It is quite common for individuals to have collections of rare or limited production items or to collect a series of items that are produced over a period of years and that each relate to a common event. Such collectibles include stamps, baseball cards, political election buttons, and pins. Depending on the nature of the collectible item, it is often desired to have a convenient carrying case that can both protect the items and display them in an attractive format. In order to protect and display both merchandise for sale and collectible items, carrying cases have been designed with rigid structures such as metal or reinforced fiber board. In addition, prior art cases have been designed with rigid compartments and retaining elements to separate items. Such prior art cases tend to be bulky or inflexible due to their rigid construction and are often heavy. Further, proper display of items in prior art cases is obstructed by structures for attaching and separating the display items.

Accordingly, it is an object of the present invention to provide an improved carrying case for collectibles or the like.

It is a further object of the invention to provide a flexible and lightweight carrying case.

It is a further object of the invention to provide a carrying case with compartments for storing collectibles and separate panels for displaying collectibles.

Another object of the present invention is to provide a carrying case that protects the collectibles from damage from both the outside and from other collectibles stored within the case.

Other objects and advantages of the present invention will be apparent to those having ordinary skill in the art in view of the following detailed discussion with accompanying drawings.

DETAILED DESCRIPTION

Figure 1:
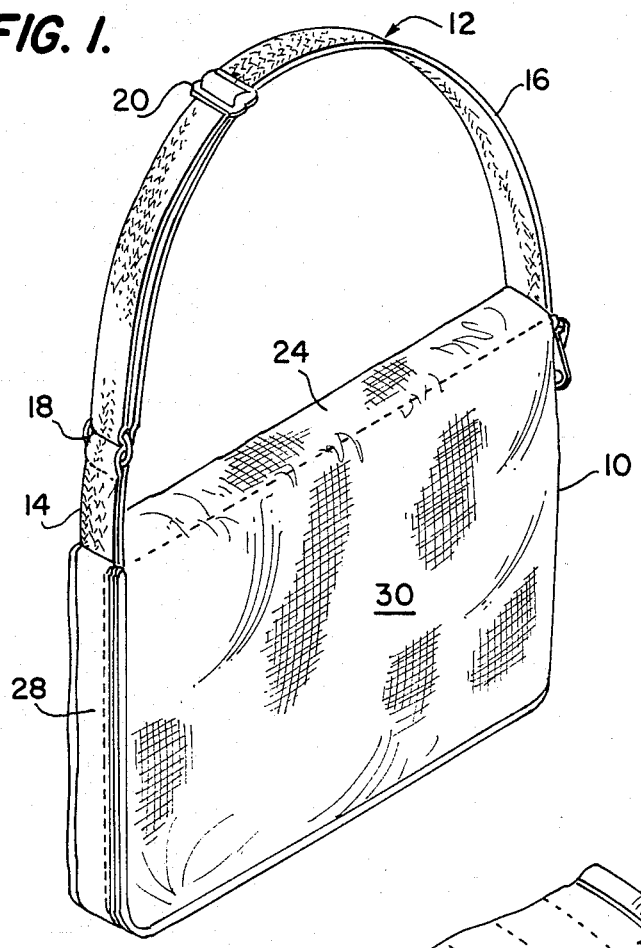
FIG. 1 is a perspective view of the collector bag of the present invention.

Referring to FIG. 1, the pin collector bag of the present invention shown generally at 10 includes a handle 12 with a fixed length belt portion 14 and an adjustable length belt portion 16. The handle 12 can be made of any suitable strong, flexible material such as closely woven cloth. Belt portion 14 is secured on the one end to bag 10, i.e. by stitching, and at its other end is secured to metal or hard plastic loop 18. Belt portion 16 is secured on one end to pin collector bag 10, again by stitching for example, and its other end passes through metal or hard plastic buckle 20, then through loop 18, and finally is secured to buckle 20. The length of handle 12 is adjusted in a conventional manner by increasing or decreasing the length of portion 16 that passes between loop 18 and buckle 20. The adjustable handle 12 permits pin collector bag 10 of the present invention to be carried by hand with a short length handle or to be carried over a shoulder with a longer length handle. This feature provides an advantage over prior art carrying cases that are generally rigid and bulky and provided only with a short, fixed length handle to permit the case to be carried by hand.

Figure 2:
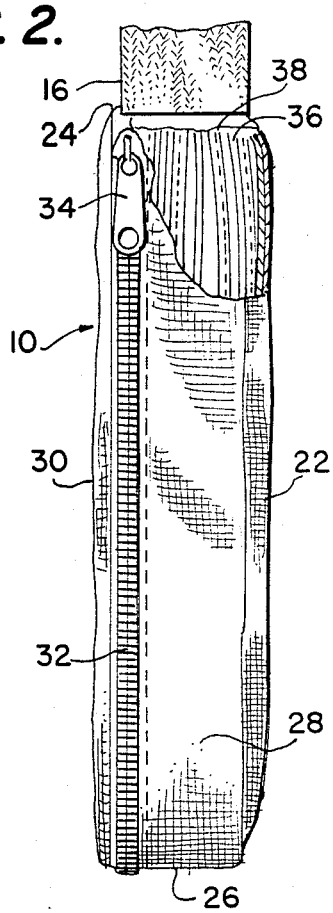
FIG. 2 is a side, partial cross-sectional view of the bag of the present invention.
Figure 3:
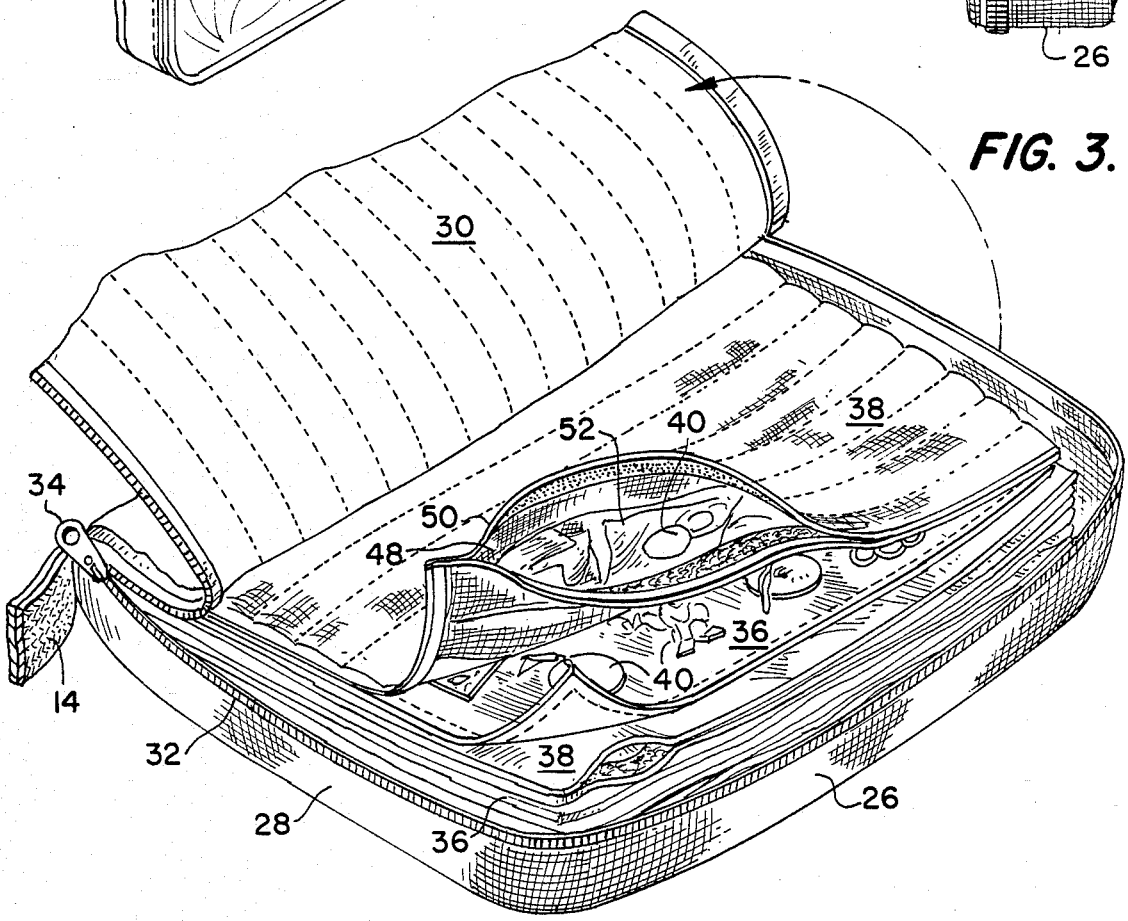
FIG. 3 is a perspective view of the bag of the present invention with the top cover open showing the compartments of the bag with the collectibles stored and displayed therein.

FIG. 2 illustrates a side partial cross-sectional view of bag 10. The bag 10 with a generally rectangular shape, includes a back 22 integrally formed or sewn with top 24 (FIG. 1), bottom 26, sides 28, and front 30. Front 30 can be opened and folded back from sides 28 and bottom 26 as best shown in FIG. 3. Front 30 is removably secured to sides 28 and bottom 26 by zipper 32 with handle 34. The bag 10 can be constructed of any strong yet pliable material such as nylon or polyester or a cloth made of woven or knitted natural fibers.

Figure 4:
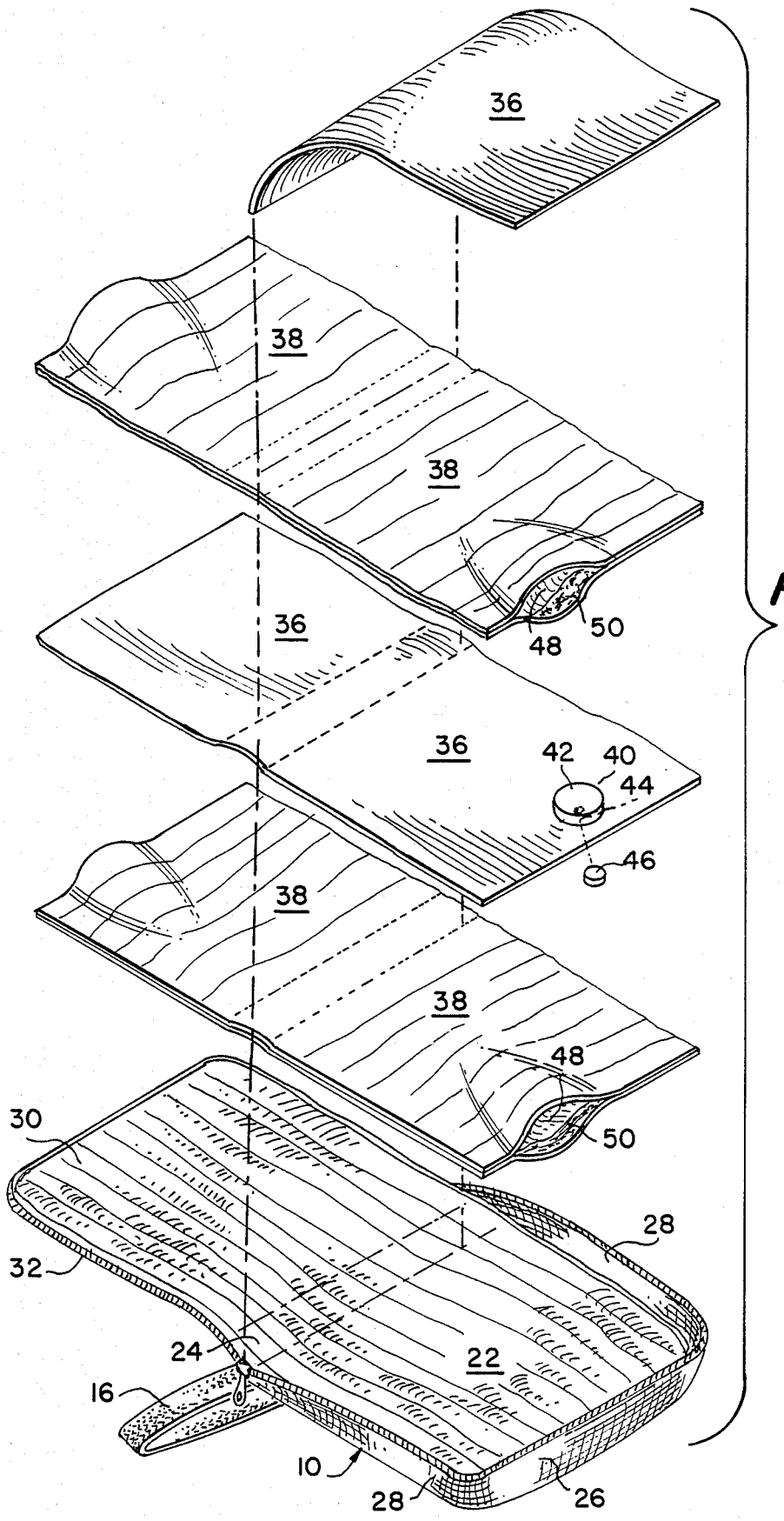
FIG. 4 is an exploded view showing the arrangement and cooperation of each of the compartments of the bag of the present invention.

As best shown in FIGS. 2 and 4, the interior of bag 10 comprises a plurality of interleaved panels 36 and pouches 38, each attached on one end to top 24. These interleaved panels 36 and pouches 38 provide a unique advantage in the present invention in that they perform the individual functions of displaying (panels 36) and storing (pouches 38) collectible items, and they function cooperatively to protect collectible items in the bag 10. As best illustrated in FIG. 3, panels 36, preferably made of a soft fabric or cloth that can be pierced by a standard pin, are positioned between two pouches 38 similarly formed of a soft and pliable material such as nylon or a cloth fabric. Panels 36 are utilized to display collectibles such as pins 40. FIG. 4 best illustrates the interior construction of bag 10 with pairs of pouches 38 positioned on either side of pairs of panels 36 sewn or stitched to top 24 of bag 10. As shown in FIG. 4, collectible pins 40 generally include a decorative face 42 and a pointed stem 44 extending from the back of face 42. The pins 40 are attached to panels 36 by piercing the panel with stem 44 and securing the pin with fastener 46. Thus, a plurality of pins 40 can be arranged and secured on each panel 36 (as shown in FIG. 3) to provide a desirable display format.

As illustrated in FIGS. 3 and 4, pouches 38 include a reclosable opening 48. Opening 48 in pouch 38 can be closed by any suitable securing means such as Velcro-like (i.e. a large plurality of miniature hooks and loops) strips 50 as shown in FIGS. 3 and 4 or, alternatively, a zipper or the like. Each pouch 38 provides a storage compartmemnt for pins 40 as shown in FIG. 3. During storage, pins 40 may be kept in individual bags such as plastic bags 52 shown in FIG. 3. In addition to providing a storage compartment, pouches 38 provide a protective layer disposed between one set of pins displayed on one panel 36 and another set of pins displayed on a second panel 36. Without intermediate protective pouches 38, fasteners 46 of pins 40 on one panel 36 would be in contact with the decorative face 42 of pins 40 displayed on a lower panel 36. Each of the pouches 38 may be formed of multiple layers of cloth or fabric sewn together to provide greater cushioning or protection for the pins contained therein and also to provide greater protection between the pins displayed on adjacent panels 36.

The unique construction of the present invention with interleaved panels and pouches made of soft material provides unique advantages over the prior art. Each display panel 36 provides security and separation for the pins without requiring any additional structure that would cover the face of the pins or detract from their appearance. The interleaved pouches 38 provide the dual function of a storage compartment for pins not on display and a protective layer or cushion for sets of pins displayed on adjacent panels. The pouches 38, panels 36 and outer body of collector bag 10 are each made of strong, yet pliable materials. Thus, the bag 10 of the present invention can be folded, bent, or stored in various positions without damage to the bag or the collectible pins stored and displayed therein.

Modifications and variations of the embodiments of the present invention described herein, becoming apparent to those skilled in the art, may be made without departing from the scope of the invention as set forth in the following claims.

I claim:

1. A bag for holding and displaying items comprising:
an outer body with a reclosable front portion;
at least one panel for displaying said items;
at least one pouch for holding said items in an interior of said pouch,
said panel and said pouch being attached to said body with said pouch overlying said panel to cover and protect items displayed on said panel when said front portion is closed.

2. A bag according to claim 1 wherein said at least one panel is formed of a soft material.

3. A bag according to claim 1 wherein said items to be displayed include a face and stem attached to said face and said at least one panel is formed of a material that can be easily pierced by said stem whereby said item is attachable to said panel by piercing said stem through said panel.

4. A bag according to claim 3 wherein said items further include a fastener for cooperative engagement with said stem to secure said item to said panel.

5. A bag according to claim 1 wherein said at least one pouch is made of soft, flexible material.

6. A bag according to claim 1 wherein said pouch includes a reclosable opening.

7. A bag according to claim 6 wherein said pouch opening includes cooperating strips for securing said opening in a closed position.

8. A bag according to claim 1 wherein said outer body is made of a soft pliable material.

9. A bag according to claim 1 wherein said outer body includes a zipper for securing said front portion in a closed position.

10. A bag according to claim 1 further including an adjustable-length handle.

11. A bag according to claim 1 including at least two panels and said at least one pouch being interposed between said two panels, whereby said pouch prevents items displayed on a first panel from contacting items displayed on a second panel.

12. A bag according to claim 1 including at least two pouches with said at least one panel being interposed between said two pouches, whereby said pouches provide a protective layer on either side of said panel for items being displayed on said panel.

13. A bag according to claim 1 wherein said at least one pouch is made of a pliable material.

14. A bag according to claim 1 wherein said outer body, said panel, and said pouch are formed of a soft pliable material.

15. A bag for holding and displaying items comprising:
an outer body with a reclosable front portion;
at least two panels for displaying said items;
at least one pouch for holding said items in an interior of said pouch, said pouch being interposed between said two panels, whereby said pouch prevents items displayed on a first panel from contacting items displayed on a second panel.

16. A bag for holding and displaying items comprising:
an outer body with a reclosable front portion;
at least one panel for displaying said items;
at least tow pouches for holding said items in an interior of each said pouch, said panel being interposed between said two pouches, whereby said pouches provide a protective layer on either side of said panel for items being displayed on said panel.

17. A bag according to claim 15 or 16 wherein said panel is formed of a soft material.

18. A bag according to claim 15 or 16 wherein said items to be displayed include a face and stem attached to said face and said panel is formed of a material that can be easily pierced by said stem whereby said item is attachable to said panel by piercing said stem through said panel.

19. A bag according to claim 18 wherein said items further include a fastener for cooperative engagement with said stem to secure said item to said panel.

20. A bag according to claim 15 or 16 wherein said pouch is made of soft, flexible material.

21. A bag according to claim 15 or 16 wherein said pouch includes a reclosable opening.

22. A bag according to claim 21 wherein said pouch opening includes cooperating strips for securing said opening in a closed position.

23. A bag according to claim 15 or 16 wherein said outer body is made of a soft pliable material.

24. A bag according to claim 15 or 16 wherein said outer body includes a zipper for securing said front portion in a closed position.

25. A bag according to claim 15 or 16 further including an adjustable-length handle.

26. A bag according to claim 15 or 16 wherein said pouch is made of a pliable material.

27. A bag according to claim 15 or 16 wherein said outer body, said panel, and said pouch are formed of a soft pliable material.

* * * * *